US007661212B2

(12) United States Patent
Hahn

(10) Patent No.: US 7,661,212 B2
(45) Date of Patent: Feb. 16, 2010

(54) APPLIANCE FOR IRONING OR STEAMING LINEN, COMPRISING A CONTAINER FOR ADDITIVE

(75) Inventor: Matthias Hahn, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 11/908,004

(22) PCT Filed: Feb. 6, 2006

(86) PCT No.: PCT/IB2006/000284

§ 371 (c)(1),
(2), (4) Date: Sep. 7, 2007

(87) PCT Pub. No.: WO2006/095226

PCT Pub. Date: Sep. 14, 2006

(65) Prior Publication Data

US 2008/0168688 A1 Jul. 17, 2008

(30) Foreign Application Priority Data

Mar. 7, 2005 (FR) ..... 05 02255

(51) Int. Cl.
*D06F 75/22* (2006.01)
*B01D 27/02* (2006.01)
*D06F 79/00* (2006.01)
*B01D 27/08* (2006.01)

(52) U.S. Cl. ..... 38/81; 38/93; 38/97; 210/282

(58) Field of Classification Search ..... 38/74, 38/75, 76, 77.1, 77.2, 77.9, 80, 81, 88, 93, 38/97; 210/282
See application file for complete search history.

(56) References Cited

U.S. PATENT DOCUMENTS

| | | | | |
|---|---|---|---|---|
| 3,269,040 | A * | 8/1966 | Dikoff | 38/97 |
| 3,442,692 | A * | 5/1969 | Gaiser | 427/240 |
| 3,721,026 | A * | 3/1973 | McCallum | 38/75 |
| 4,439,581 | A * | 3/1984 | Irii et al. | 524/839 |
| 4,567,675 | A * | 2/1986 | Rennie | 34/60 |
| 4,893,422 | A * | 1/1990 | Mahlich et al. | 38/77.3 |
| 5,138,778 | A * | 8/1992 | Brandolini | 38/77.8 |
| 5,507,108 | A * | 4/1996 | Bruggink et al. | 38/77.8 |
| 5,526,595 | A * | 6/1996 | Daulasim et al. | 38/77.8 |
| 5,966,831 | A | 10/1999 | Anserson | |
| 6,163,990 | A * | 12/2000 | Urata et al. | 38/77.8 |
| 6,351,901 | B1 | 3/2002 | Amsel | |
| 6,427,366 | B2 * | 8/2002 | Horn et al. | 38/77.83 |
| 6,604,297 | B2 * | 8/2003 | Hagemann et al. | 34/380 |

(Continued)

FOREIGN PATENT DOCUMENTS

EP 1443058 A1 8/2004

(Continued)

*Primary Examiner*—Ismael Izaguirre
(74) *Attorney, Agent, or Firm*—Browdy and Neimark, PLLC

(57) ABSTRACT

The invention relates to an appliance for ironing or steaming linen, comprising a device which is used spread an additive over the linen and a container for said additive (20). The invention is characterized in that the additive container (20) comprises a substrate (22) bearing microcapsules and in that said microcapsules are carried progressively by a flow of fluid discharged by the device in order to spread the additive over the linen, said flow conveying the microcapsules outside of the appliance.

14 Claims, 1 Drawing Sheet

U.S. PATENT DOCUMENTS

| | | | | |
|---|---|---|---|---|
| 6,625,910 | B2 * | 9/2003 | Ching et al. | 38/77.3 |
| 6,986,217 | B2 * | 1/2006 | Leung et al. | 38/77.83 |
| 7,056,877 | B2 * | 6/2006 | Caswell et al. | 510/439 |
| 2002/0050081 | A1 | 5/2002 | Ching et al. | |
| 2004/0087475 | A1 * | 5/2004 | Jonke et al. | 510/515 |
| 2005/0217152 | A1 | 10/2005 | Pessayre et al. | |
| 2005/0238608 | A1 | 10/2005 | Ouali et al. | |

FOREIGN PATENT DOCUMENTS

| | | | |
|---|---|---|---|
| EP | 1449911 | A1 | 8/2004 |
| EP | 1582620 | A1 | 10/2005 |
| FR | 00263233 | A1 * | 12/1989 |
| FR | 2822480 | A1 | 9/2002 |
| WO | 9806890 | A1 | 2/1998 |
| WO | 0202859 | A2 | 1/2002 |

* cited by examiner

APPLIANCE FOR IRONING OR STEAMING LINEN, COMPRISING A CONTAINER FOR ADDITIVE

The present invention relates to an appliance for ironing or smoothing linen and more particularly to an appliance of this type comprising a device to spread an additive on the linen.

There is known from the document WO98/06890 a steam appliance for smoothing linen comprising an additive container that is traversed by a steam flow, the container containing disinfecting plants or a perfume whose active substance is transported with the steam onto the linen in order to disinfect or scent the latter.

Such a device to spread an additive however presents the disadvantage of having an additive container that is largely open to the circulation of air so that the additive is diffused outside the appliance even when the latter is not used. There results a rapid exhaustion of the effectiveness of the additive and an excessive diffusion of the additive at the location where the appliance is stored, which can generate harmful effects in particular when the additive is a perfume.

Thus, a goal of this invention is to remedy these disadvantages.

For this purpose, the invention has as an object an appliance to iron or smooth linen having a device to spread an additive on the linen comprising an additive container, characterized in that the additive container comprises a substrate that supports microcapsules and in what the microcapsules of the substrate are gradually carried by a flow of fluid emitted by the device to spread the additive on the linen, the flow transporting the microcapsules out of the appliance.

Such a characteristic makes it possible to obtain a container of microcapsules in solid form that can be easily handled or transported and that has the advantage of being easily adaptable to many appliances.

The membrane of the microcapsules is preferably made of a material that is chemically compatible with materials of the device used to spread the additive. By chemically compatible material, one understands a material that does not degrade in a perceptible way the materials of the device for spreading the additive over the lifespan of the appliance.

Microencapsulation of the additive has the advantage of eliminating direct contact between the additive and the elements of the device permitting spreading the additive, which makes it possible to reduce the problems of chemical attack or clogging related to the nature of the additive.

In the case of the use of an additive sensitive to a rise in temperature, such as essential oils, microencapsulation also has the advantage of preventing the additive from losing its effect when the additive container is subjected to high temperatures.

Finally, microencapsulation of the additive has the advantage of avoiding diffusion of the additive into the atmosphere during its storage or when it is spread by means of a spray device. Inhalation of the additive by the user is thus avoided.

According to another characteristic of the appliance according to the invention, the microcapsules are adhered or impregnated on the substrate.

According to another characteristic of the appliance according to the invention, the appliance is a steam appliance and the device for spreading the additive is a spray device using the driving force of the steam.

Such a characteristic has the advantage of allowing obtaining a powerful sprayer at low cost, the encapsulation of the additive making it possible to very greatly limit the emission into the atmosphere of the additive inherent to spraying.

According to another characteristic of the appliance according to the invention, the substrate is a textile impregnated with microcapsules and the spray device comprises means for sending a steam flow through the textile.

According to another characteristic of the appliance according to the invention, the substrate is a grid to which microcapsules are adhered and the spray device comprises means for sending a steam flow through the grid.

According to another characteristic of the appliance according to the invention, the additive contained in the microcapsules comprises a perfume or an active anti-odor ingredient, such as undecylenic acid.

According to another characteristic of the appliance according to the invention, the container is removable from the iron.

Such a characteristic makes it possible to fill the container easily or to quickly exchange it with another.

The invention also relates to a removable container intended to equip an appliance for ironing or smoothing linen such as previously described, characterized in that it contains at least one additive conditioned in the form of microcapsules, said microcapsules being supported by a substrate.

According to another characteristic of the container according to the invention, the microcapsules are adhered or impregnated on the substrate.

According to another characteristic of the container according to the invention, the substrate is a textile impregnated with microcapsules.

According to still another characteristic of the container according to the invention, the substrate is a grid on which microcapsules are adhered.

One will understand better the goals, aspects and advantages of this invention, according to the description given hereafter of particular embodiments of the invention presented as nonrestrictive examples, while referring to the annexed drawings in which:

Only the elements necessary for an understanding of the invention have been represented. To facilitate reading of the drawings the same elements carry the same references from one figure to the other.

FIGS. 1 to 3 show a particular embodiment of the invention in which the invention is applied to an appliance that can be used for smoothing textiles by only steam emission, i.e., without there being contact of a hot soleplate with the textile, for example to improve the appearance of fragile curtains.

Figure 1:
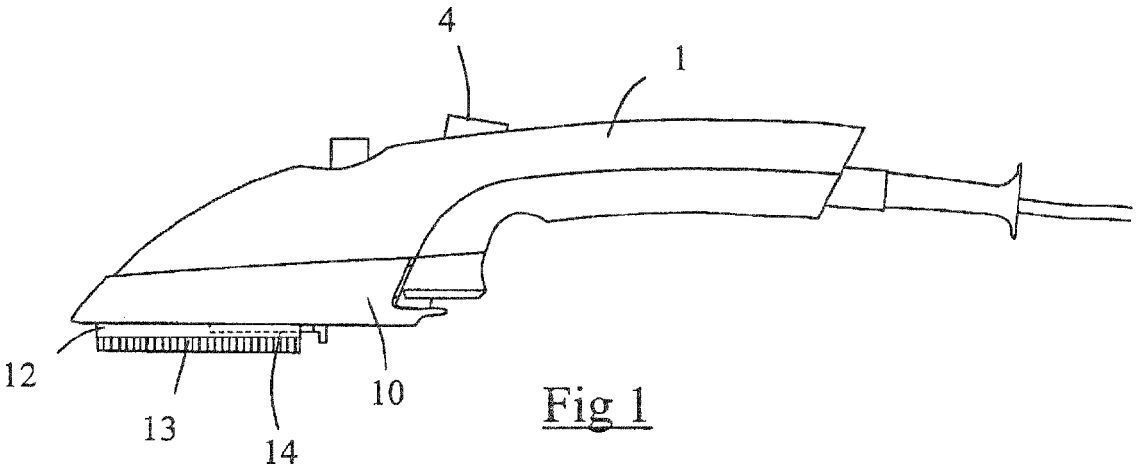
FIG. 1 shows a side view of a smoothing appliance provided with an additive container according to a particular embodiment of the invention.
Figure 2:
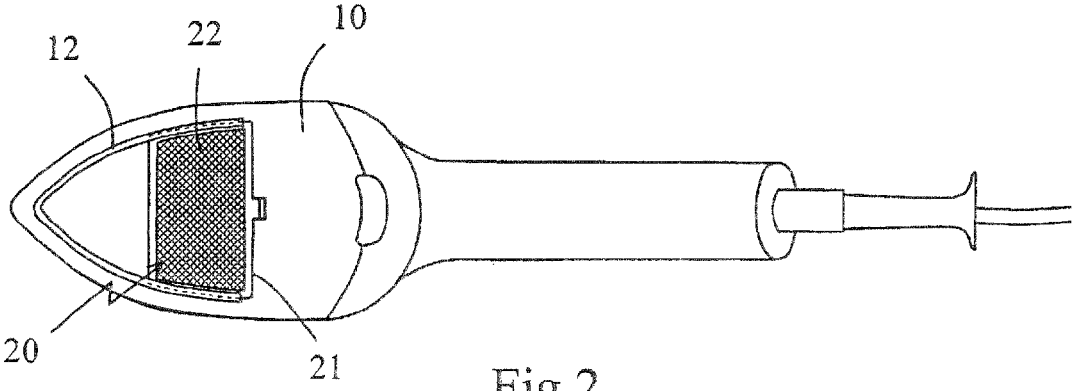
FIG. 2 shows a bottom view of the appliance of FIG. 1 equipped with the additive container according to the invention.
Figure 3:
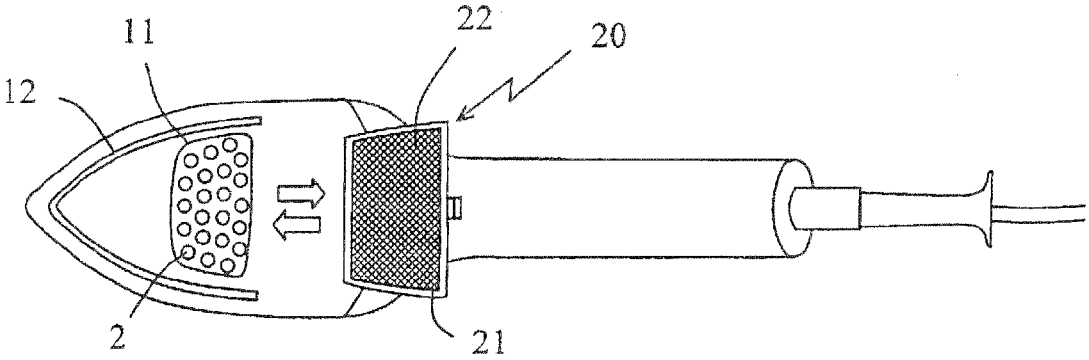
FIG. 3 is a view similar to FIG. 2 illustrating the direction of assembly and disassembly of the container.

The appliance illustrated in these figures is similar to that described in the patent application FR 2 822 480 and conventionally comprises a plastic body 1 forming a handle and a metal soleplate, not visible in the figures, in thermal relation with a heating body in which a steam chamber is disposed. A removable water container, not represented, is housed inside the handle. Water is propelled into the steam chamber by a manual pump actuated by pressure on a control 4, the steam escaping through orifices 2 distributed on the soleplate.

The soleplate is covered by a plastic accessory 10 forming an envelope surrounding the soleplate of the iron and preventing the hot soleplate of the iron from coming in direct contact with the textile. Accessory 10 has a passage 11 whose surface is placed in correspondence with orifices 2 for outlet of steam from the iron and presents a rib 12 supporting a line of bristles constituting a brush 13.

Accessory 10 is fixed in a removable manner on body 1 of the iron, in a manner known per se, for example by latching. Inside the accessory, around passage 11, a pad carrying a seal ensures the sealing with respect to the steam when the accessory is mounted on the iron.

More particularly according to the invention, the iron receives an additive container 20 mounted in a removable way facing orifices 2 for the exit of steam from the soleplate, container 20 having a framework 21 supporting a substrate 22 that is permeable to the steam on which microcapsules of additives are adhered or impregnated.

Support framework 21 engages laterally in grooves 14 formed on the interior edge of rib 12 supporting brush 13 and is immobilized in position by elastic bosses. Substrate 22 is preferably placed at a distance of about 5 mm from outlet orifices 2 to obtain a distribution of the steam across the entire substrate 22.

As an example, substrate 22 is preferably constituted by a fabric impregnated with microcapsules or a metal grid on which the microcapsules are adhered. Substrate 22 can thus be constituted by a lattice formed of wool strands supported by the support framework 21 and impregnated with a solution of microcapsules of additive.

The microcapsules are preferably constituted by capsules with polymeric walls of a diameter of several micrometers and are prepared according to a process known per se, for example according to one of the processes described in the French patents FR 1 334 918 and FR 2 548 046.

The membranes of the microcapsules will be, for example, made out of melamine-formaldehyde. The additive contained in the microcapsules is advantageously selected among perfumes or known anti-bacterial or anti-odor active ingredients, such as undecylenic acid ($CH_2{=}CH(CH_2)_8COOH$).

The adhesive strength of the adhesive or the impregnation liquid is advantageously selected so that the microcapsules remain attached to substrate 22 when the latter is at ambient temperature but are detached from substrate 22 when they are subjected to a steam flow.

With this appliance, when the user wishes to treat his linen with an additive, he engages the additive container 20 in grooves 14 so that substrate 22 comes in front of orifices 2. The user then presses control 4 to generate a steam flow that is sent via steam outlet orifices 2 through substrate 22. The thermal and hygrometric actions generated by the steam flow then cause progressive detachment of the microcapsules from substrate 22 and the microcapsules thus released are transported by the steam flow to the textile to be treated.

Additive container 20 thus constituted can be used several times by the user, until exhaustion of the microcapsules contained in substrate 22. Such an additive container has the advantage of being able to be stored without there being significant emanations of the additive. The additive container could thus be stored for a long time without there being a significant exhaustion of the effectiveness of the additive and without a problem of pollution of the environment. The microencapsulation of the additive also has the advantage of avoiding clogging of the substrate which the nature of the additive could provoke and of protecting the additive thermally when it is swept by the steam flow, which thus makes it possible to preserve its integrity.

Of course, the invention is by no means limited to the described and illustrated embodiments, which have been given only as examples. Modifications remain possible, in particular from the point of view of the constitution of the various elements or by substitution of technical equivalents, without departing for that matter the field protection of the invention.

The invention claimed is:

1. Appliance to iron or smooth linen having a device to spread an additive on the linen outside said appliance, comprising an additive container (20), characterized in that the additive container (20) comprises a substrate (22) and said appliance comprises microcapsules contained in said container and supported on said substrate, said microcapsules containing the additive, and in that the microcapsules of the substrate are gradually carried by a flow of fluid emitted by the device to spread the additive on the linen, wherein said appliance has openings via which the fluid flows out of said appliance and said flow of fluid transports said microcapsules out of the appliance and onto the linen.

2. Appliance according to claim 1, characterized in that the microcapsules are adhered or impregnated on the substrate.

3. Appliance according to claim 1, characterized in that the additive contained in the microcapsules comprises a perfume or an active anti-odor ingredient.

4. Appliance according to claim 1, characterized in that the container (20) is removable from said appliance.

5. Appliance according to claim 1, characterized in that the additive contained in the microcapsules comprises undecylenic acid.

6. Appliance to iron or smooth linen having a device to spread an additive on the linen comprising an additive container (20), characterized in that the additive container (20) comprises a substrate (22) and said appliance comprises microcapsules contained in said container and supported on said substrate, said microcapsules containing the additive, and in that the microcapsules of the substrate are gradually carried by a flow of fluid emitted by the device to spread the additive on the linen, said flow transporting said microcapsules out of the appliance, and further characterized in that the appliance is a steam appliance and the device for spreading the additive is a spray device using the driving force of the steam.

7. Appliance according to claim 6, characterized in that said substrate (22) is a textile impregnated with microcapsules and the spray device comprises means for sending a steam flow through said textile.

8. Appliance according to claim 6, characterized in that said substrate (22) is a grid to which microcapsules are adhered and the spray device comprises means for sending a steam flow through said grid.

9. Removable container (20) intended to equip an appliance for ironing or smoothing linen that is disposed outside of the appliance, characterized in that said container contains microcapsules and at least one additive encapsulated in said microcapsules, said microcapsules being supported by a substrate and being adapted to be gradually carried by a flow of fluid emitted from the appliance to spread the additive on the linen, said flow transporting said microcapsules out of the appliance and onto the linen.

10. Removable container according to claim 9, characterized in that the microcapsules are adhered or impregnated on said substrate (22).

11. Removable container according to claim 10, characterized in that the substrate (22) is a textile impregnated with microcapsules.

12. Removable container according to claim 10, characterized in that the substrate (22) is a grid on which microcapsules are adhered.

13. Appliance to iron or smooth linen having a device to spread an additive on the linen comprising an additive container (20), characterized in that the additive container (20) comprises a substrate (22) and said appliance comprise microcapsules contained in said container and supported on said substrate, said microcapsules containing the additive, and in that the microcapsules of the substrate are gradually carried by a flow of fluid emitted by the device to spread the additive on the linen, said flow transporting said microcapsules out of the appliance, and further characterized in that:

the appliance is a steam appliance and the device for spreading the additive is a spray device using the driving force of the steam;

said substrate (22) is a textile impregnated with microcapsules and the spray device comprises means for sending a steam flow through said textile;

said substrate (22) is a grid to which microcapsules are adhered and the spray device comprises means for sending a steam flow through said grid;

the additive contained in the microcapsules comprises a perfume or an active anti-odor ingredient; and the container (20) is removable from said appliance.

14. Appliance according to claim 13, characterized in that the additive is undecylenic acid.

* * * * *